US006282820B1

(12) United States Patent
White et al.

(10) Patent No.: US 6,282,820 B1
(45) Date of Patent: Sep. 4, 2001

(54) CIRCULATING FLUID AMUSEMENT DEVICE

(76) Inventors: Michael L. White; Patricia E. White, both of 5863 W. Del Lago Cir., Glendale, AZ (US) 85308

( * ) Notice: Subject to any disclaimer, the term of this patent is extended or adjusted under 35 U.S.C. 154(b) by 187 days.

(21) Appl. No.: 08/958,497

(22) Filed: Oct. 27, 1997

Related U.S. Application Data

(60) Provisional application No. 60/070,903, filed on Oct. 29, 1996.

(51) Int. Cl.[7] ..... G09F 19/00

(52) U.S. Cl. ..... 40/410; 40/406; 40/409; 40/426

(58) Field of Search ..... 40/406, 409, 410, 40/414, 423, 426; 446/138, 267

(56) References Cited

U.S. PATENT DOCUMENTS 3,006,111 * 10/1961 Koch ..... 40/426 X
4,162,855 * 7/1979 Bender ..... 366/274
4,757,986 * 7/1988 Hwang et al. ..... 40/426 X
4,817,311 * 4/1989 Ong ..... 40/406 X
4,852,283 * 8/1989 Teng ..... 40/426
5,189,821 * 3/1993 Lee ..... 40/406
5,213,540 * 5/1993 Yang ..... 40/410 X
5,313,727 * 5/1994 Murray, Jr. ..... 446/267 X
5,435,086 * 7/1995 Huang ..... 40/426
5,491,916 * 2/1996 Ingram et al. ..... 40/410
5,502,908 * 4/1996 Powell et al. ..... 40/410
5,732,492 * 3/1998 Lin ..... 40/410
5,775,014 * 7/1998 Lin ..... 40/406
5,875,577 * 3/1999 Lu ..... 40/411

* cited by examiner

*Primary Examiner*—B. Dayoan
*Assistant Examiner*—Andrea Chop
(74) *Attorney, Agent, or Firm*—Michael L. White

(57) ABSTRACT

A fluid filled novelty amusement device with a magnetic impeller 9 driven by an electric motor 16, through a magnetic couple created between a magnetic rotor 15 and the magnetic impeller 9, that provides forced circulating fluid 3 flow that entrains and disperses ornamental particles 2 throughout a transparent enclosure 1 to provide viewing entertainment.

6 Claims, 1 Drawing Sheet

CIRCULATING FLUID AMUSEMENT DEVICE

This non-provisional application claims the benefit of earlier filing date and right of priority conferred through a prior provisional application No. 60/070,903 filed Oct. 29, 1996.

BACKGROUND OF THE INVENTION

1. Field of the Invention

This invention relates to amusement devices used for entertainment and decoration that have a fluid filled transparent enclosure in which decorative particles can be suspended by fluid agitation and typically display a figurine within the enclosure.

2. Description of Related Art

At their most fundamental level these amusement devices (often termed snow globes, or water globes, among other variations), require manual shaking to disperse the decorative particles inside the fluid filled enclosure. However, the decorative particles soon settle to the bottom of the enclosure and the ornamental value of the device is lost. Almost constant manual agitation is required to maintain the ornamental effect of the particles swirling around the figurine. Consequently, the snow globe is usually displayed without particle movement, in a lack luster state. This does not set off the globe to its most aesthetic and interesting advantage.

Considerable inventive activity has been directed at the development of mechanical or electrical powered systems that aromatically disperse the decorative particles in these amusement devices. These improved devices have used mechanical and electrical motors to drive small pumps that agitate the enclosure fluid to disperse the decorative particles. These patents include Murray (U.S. Pat. No. 5,313,727), Ingram (U.S. Pat. No. 5,491,916), Powell (U.S. Pat. No. 5,502,908), and Ong (U.S. Pat. No. 4,817,311).

The resultant continuous particle movement created by these improved devices creates a pleasing visual effect for both amusement and decoration without the need for manual agitation. Viewers can enjoy the show globe in its most visually interesting and pleasing aesthetic state without the bother of manually agitating the device.

However, all of the above referenced patents suffer from the same basic design flaw. All of these devices utilize a mechanical shaft to transmit power from the driver (e.g., electric motor or mechanical spring) to the pump. Because the shaft must protrude into the fluid filled snow globe to power the pump, all of the above patented devices suffer from the same problem, shaft leakage. Although the shaft is sealed with some sort of mechanical seal to prevent leakage, no mechanical seal can perfectly seal a fluid. Some leakage is always present because of the seepage that any seal will experience. Furthermore, this seal is eventually guaranteed to fail and leak catastrophically. These leaks occur because the seal wears, or the seal material degrades, or the seal becomes misaligned.

Because of the ornamental nature of snow globes, they are often displayed on wood furniture such as tables and cabinetry. In these vulnerable areas there is no allowable tolerance for leakage because of the water damage that will occur to the wood. Even the slight seepage that can be expected is too much moisture in these areas. None of the patents disclosed above has resolved this leakage problem.

SUMMARY OF THE INVENTION

This invention relates to a new and useful improvement in snow globes for the continuous circulation and dispersion of particles inside the globe. The greatest advantage of this invention is that a simple, economical method has been developed to provide a reliable leak proof seal. This invention improves upon the prior art with the application of a magnetic coupling of the drive mechanism to the pump. The mechanical coupling allows the pump and all of the pump's components to be hermetically sealed. Thus, the fluid boundary is never penetrated. Leakage is impossible because there is no mechanical shaft penetrating the fluid boundary.

Another advantage of this invention over the prior art is that fewer and simpler components are required to make this invention operable. For example the present invention requires neither a mechanical seal nor a shaft. Furthermore, none of the ancillary components required to couple the drive shaft to the drive and the impeller are required. As a result the assembly cost for the present invention is also reduced.

All other systems require a seal to accommodate a rotating shaft connecting the motor to the impeller. Such a seal will wear and eventually leak. This invention on the other hand, does not require a seal because the fluid boundary is never breached. The fluid boundary is hermetically sealed with either water proof epoxy compounds or other related adhesive materials.

Besides the objects and advantages described above, several additional objects and advantages of the present invention are:

1. The speed of the electric pump can be electronically controlled allowing the fluid velocity, and in turn, the particle velocity to be controlled and adjusted to its most pleasing state.

2. The pump can be alternately pulsed on and off thus creating a more interesting scene by virtue of the constantly changing conditions within the globe created by varying particle velocities and distribution.

Still, further objects and advantages will become apparent from a consideration of the ensuing description and drawings.

DESCRIPTION OF THE PREFERRED EMBODIMENTS

Figure 1:
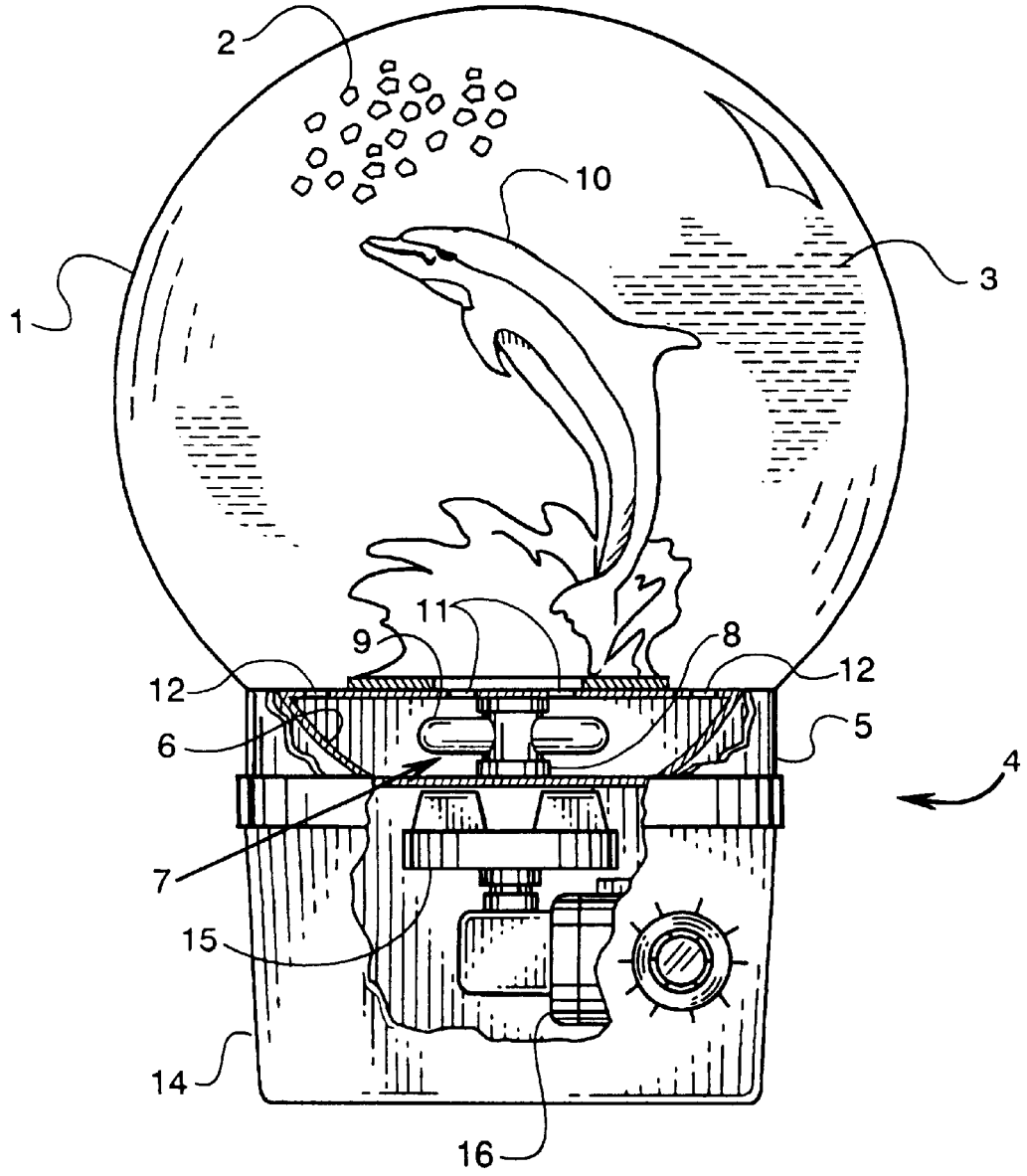
FIG. 1 is a front elevation view of a complete circulating fluid amusement device, including the transparent enclosure, base, decorative particles, and a cut away view to show the magnetic drive mechanism powered by an electric motor with outlet ports located along the circumference of the upper housing.

A preferred embodiment of a circulating fluid amusement device of the present invention is illustrated in FIG. 1 (cross section view). The circulating fluid snow globe consists of a fluid filled transparent enclosure 1 with a base 4 sealing the open end of the enclosure. The enclosure is typically made from transparent plastic or glass. Disposed within the enclosure are decorative particles 2. These decorative particles typically have a snow like appearance or a metallic glitter-like appearance. The base consists of an upper housing 5 and a lower housing 14. The upper housing is in direct contact with the globe fluid.

The upper housing contains the impeller 9, suction ports 11, and discharge ports 12. The impeller 9 is rotatably attached in the upper housing 5. The upper housing is hermetically sealed from the lower housing of the base. The ornamental elements commonly displayed inside the globe, such a figurine (10) are attached above the upper housing inside the enclosure. The suction ports 11 and discharge ports 12 can be arranged in a variety of geometrical variations. These variations may be optimized to reduce the view of the intake slots and discharge ports. This preserves the aesthetic qualities of the displayed ornamentation. The lower housing 14 contains the remainder of the drive mechanism including the rotor 15, and the mechanical or electrical driver 16 for the rotor 15.

The preferred embodiment of this invention uses an impeller assembly 7 that consists of an impeller 9 formed from a bar magnet, a hub 8 substantially fixed in the horizontal and vertical planes, but free to rotate. This impeller assembly is of known design of the type as described by Bender in utility U.S. pat. No. 4,162,855. The major axis of the impeller 9 is mounted substantially in the horizontal plane through and affixed to the hub. Limiting the horizontal and vertical movement of the hub 8 ensures that the rotor 15 and the impeller 9 remain in alignment.

Another general embodiment of this invention uses a drive mechanism powered by a mechanical spring. The spring is wound to provide power to drive the rotor 15. However, the duration of this power source is extemely limited in comparison to supplying either battery or household current to an electric motor.

Operational Description

This invention dramatically changes the manner of use and display of traditional snow globes and similar amusement devices. In the past a snow globe required manual agitation to affect the desired display of falling snow (or other decorative particles). This new invention provides a constant display of circulating particles without the nuisance of providing constant manual agitation.

The drive mechanism is started to commence the circulation of the fluid and entrain the particles 2. In the preferred embodiment the drive mechanism is an electric motor 16. A DC power source is optimal for this application because of the small motor size required. Low voltage DC power is also preferred because of safety concerns related to the use of electricity in proximity with water. This DC power source may be either from batteries or rectified AC current.

This magnetic drive is of known design such as described in U.S. Pat. No. 4,162,855 to Bender issued Jul. 31, 1979. In the preferred embodiment the drive mechanism is an electric motor 16 which is connected by suitable mechanical means to a rotor 15 and causes the rotor 15 to rotate about its minor axis. The rotor 15 has both a north and south magnetic pole. This rotor in the lower housing 14 of the base 4, and the impeller 9 housed in the upper housing 5 of the base, are electromagnetically coupled. Consequently, the rotor 15 magnetically aligns and couples itself with the impeller 9. The rotational movement of the electric motor-driven rotor 15 is magnetically transferred to the impeller 9.

Critical to the functionality of this device is the use of both a magnetic rotor and magnetic impeller. Otherwise, the coupling force between the rotor and impeller will be insufficient to transmit the required torque to obtain the necessary fluid velocities. Furthermore, unless both the impeller and rotor are magnetic, the impeller will fall out of synchronization with the impeller. When both the impeller and the rotor have magnetic poles, any lack of synchronization is corrected as like poles repel and synchronize the rotor to the impeller.

The rotating impeller 9 centrifugally displaces fluid 3 through the discharge ports. This discharge fluid entrains the decorative particles 2 and circulates the particles upward from the base 4. Incoming fluid enters through the inlet suction port 11 leading to the center of the impeller 9. Centrifugally expelling the incoming fluid 3 through the discharge ports 12 completes the closed pumping cycle. FIG. 1 shows the typical circulating pattern of the fluid 3 and entrained particles 2 established by the impeller 9.

The radially outward flow created by the impellers centrifugal force can be more efficiently harnessed by including a flow deflector (6) in the upper housing that directs the substantially horizontal flow initially produced by the impeller to a substantially vertical flow. This reduces turbulence, maximizes laminar flow, and allows the device to operate more efficiently. In addition, with or without the flow straightener, the discharge ports can be altered and arranged to provide varied circulating flow patterns. For example, the discharge slots around the perimeter of the upper housing can be angled to provide a vortex flow pattern.

Although the dispersion above contains many specifics, these should not be construed as limiting the scope of the invention but as merely providing illustrations of some presently preferred embodiments of this invention. Although a specific embodiment of the invention has been described and shown, it is apparent that some minor changes of structure and operation could be made without departing from the spirit of the invention as defined by the scope of the appended claims.

For example, the invention may include an electrical circuit capable of providing intermittent or pulsed operation. This will not only conserve energy, but will also provide greater variety in the various ornamental particle distributions that can be achieved. Such an electrical circuit can also be used to vary the fluid velocity within the globe to achieve various visual effects.

In addition, the impeller itself may take on a variety of geometrical forms to achieve the greatest fluid pumping efficiencies. For example, the impeller can be hydrodynamically shaped to achieve greater energy conserving efficiencies.

Thus, the appended claims and their legal equivalents should determine the scope of the invention, rather than by the examples provided.

We claim:

1. An improved fluid filled amusement device that comprises:

a) an enclosure with an opening, said enclosure substantially transparent;

b) a fluid substantially filling said enclosure;

c) a plurality of particles disposed inside said enclosure;

d) a base attached to said enclosure forming a watertight seal between said base and said enclosure, said base having an upper and lower housing, said upper housing hermetically sealed from said lower housing;

e) an impeller disposed in said upper housing, said impeller further having a plurality of magnetic poles;

f) a rotor, said rotor rotatably mounted in said lower housing, said rotor further having a plurality of magnetic poles, said rotor closely spaced and aligned to said impeller to form a plurality of magnetic couples; and g) a drive mechanism disposed in said lower housing, said drive mechanism connected to said rotor to rotate said rotor.

2. An improved fluid filled amusement device as described in claim 1 wherein said impeller has a hub, said hub affixed to said impeller and extending perpendicularly from said impeller, said hub rotatably mounted in said upper housing.

3. An improved fluid filled amusement device as described in claim 1 further having a hub, said hub affixed in said upper housing, said impeller rotatably mounted to said hub.

4. An improved fluid filled amusement device that comprises:

a) an enclosure with an opening, said enclosure substantially transparent;

b) a fluid substantially filling said enclosure;

c) a plurality of particles disposed inside said enclosure;

d) a base attached to said enclosure forming a watertight seal between said base and said enclosure, said base having an upper and lower housing, said upper housing hermetically sealed from said lower housing;

e) at least one suction port located in the upper housing;

f) at least one discharge port located in said upper housing;

g) an impeller disposed in said upper housing, said impeller further having a plurality of magnetic poles;

h) a rotor, said rotor rotatably mounted in said lower housing, said rotor further having a plurality of magnetic poles, said rotor closely spaced and aligned to said impeller to form a plurality of magnetic couples; and i) a drive mechanism disposed in said lower housing, said drive mechanism connected to said rotor to rotate said rotor.

5. An improved fluid filled amusement device as described in claim 4 wherein said impeller has a hub, said hub affixed to said impeller and extending perpendicularly from said impeller, said hub rotatably mounted in said upper housing.

6. An improved fluid filled amusement device as described in claim 4 further having a hub, said hub affixed in said upper housing, said impeller rotatably mounted to said hub.

* * * * *